US007906185B2

(12) United States Patent
Courtenay et al.

(10) Patent No.: US 7,906,185 B2
(45) Date of Patent: Mar. 15, 2011

(54) INKJET RECORDING MEDIA

(75) Inventors: Silke Courtenay, San Diego, CA (US); Eric L. Burch, San Diego, CA (US); David P. Rossing, San Diego, CA (US); Tao Chen, San Diego, CA (US); Xin Cheng, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1080 days.

(21) Appl. No.: 11/700,613

(22) Filed: Jan. 30, 2007

(65) Prior Publication Data

US 2008/0182045 A1 Jul. 31, 2008

(51) Int. Cl.
*B41M 5/40* (2006.01)

(52) U.S. Cl. ..... 428/32.17; 428/32.28; 428/32.31; 428/32.34; 428/32.36

(58) Field of Classification Search ..... 428/32.17, 428/32.28, 32.31, 32.34, 32.36
See application file for complete search history.

(56) References Cited

U.S. PATENT DOCUMENTS

| | | | | |
|---|---|---|---|---|
| 5,521,002 | A | 5/1996 | Sneed | |
| 6,187,419 | B1 | 2/2001 | Kijimuta et al. | |
| 6,338,891 | B1 | 1/2002 | Kawasaki et al. | |
| 6,887,536 | B2 * | 5/2005 | De Voeght et al. | 428/32.36 |
| 6,899,930 | B2 | 5/2005 | Kiyama et al. | |
| 2002/0182379 | A1 * | 12/2002 | Schade et al. | 428/195 |
| 2003/0072925 | A1 | 4/2003 | Kiyama et al. | |
| 2004/0152819 | A1 * | 8/2004 | Cuch | 524/430 |
| 2005/0008794 | A1 | 1/2005 | Graczyk et al. | |
| 2006/0068132 | A1 | 3/2006 | Nakao et al. | |
| 2006/0182903 | A1 | 8/2006 | Sakaguchi et al. | |
| 2006/0246239 | A1 * | 11/2006 | Chen et al. | 428/32.34 |

FOREIGN PATENT DOCUMENTS

| | | | |
|---|---|---|---|
| EP | 1120281 | A1 | 8/2001 |
| EP | 1262329 | A2 | 12/2002 |
| EP | 1288010 | A2 | 3/2003 |
| EP | 1288012 | A2 | 3/2003 |
| EP | 1316433 | A2 | 6/2003 |
| EP | 1319517 | A1 | 6/2003 |
| EP | 1319518 | A2 | 6/2003 |
| EP | 1329330 | A1 | 7/2003 |
| EP | 1431053 | A2 | 6/2004 |
| EP | 1431054 | A2 | 6/2004 |
| EP | 1580017 | A1 | 9/2005 |
| EP | 1120281 | B1 | 5/2006 |

OTHER PUBLICATIONS

Sasol, reaching new frontier. Jan. 2003.*

Lee, Hyun-Kook et al.; "Influence of pigment particle size and pigment ratio on printability of glossy ink jet paper coatings"; Journal of Imaging Science and Technology; Jan.-Feb. 2005; pp. 54-60; vol. 49; ISSN 1062-3701; Soc. Imaging Sci. & Technol; USA (Abstract Only).

* cited by examiner

*Primary Examiner* — Betelhem Shewareged

(57) ABSTRACT

An ink receiving substrate includes a base substrate, and an ink receptive coating formed on the base substrate. The ink receptive coating includes a binder and a fumed silica and alumina dispersion, wherein the fumed silica and alumina dispersion includes between 5 and 30% alumina particles.

18 Claims, 6 Drawing Sheets

INKJET RECORDING MEDIA

BACKGROUND

Inkjet printing has become a popular way of recording images on various media surfaces, particularly paper, for a number of reasons, including, low printer noise, capability of high-speed recording, and multi-color recording. Additionally, these advantages of inkjet printing can be obtained at a relatively low price to consumers. Though there has been great improvement in inkjet printing, improvements are followed by increased demands from consumers for higher speeds, higher resolution, full color image formation, increased stability, etc.

In recent years, as digital cameras and other digital image collecting devices have advanced, image recording technology has attempted to keep pace by improving inkjet image recording on paper sheets and the like. The desired quality level of the inkjet recorded images ("hard copy") is that of traditional silver halide photography. In other words, consumers would like inkjet recorded images that have the color reproduction, image density, gloss, etc. that is as close to those of silver halide photography as possible.

SUMMARY

In one aspect of the present system and method, an ink receiving substrate includes a base substrate and a fumed silica formulation including between 5 and 30% alumina particles.

In another embodiment, a method for forming an ink receiving substrate includes providing a base substrate, combining a fumed silica formulation with between approximately 5 and 30% alumina particles to form a coating, and dispensing a layer of the coating on at least one surface of the base substrate.

BRIEF DESCRIPTION OF THE DRAWINGS

The accompanying drawings illustrate various embodiments of the present system and method and are a part of the specification. The illustrated embodiments are merely examples of the present system and method and do not limit the scope thereof.

Throughout the drawings, identical reference numbers designate similar, but not necessarily identical, elements.

DETAILED DESCRIPTION

Figure 1:
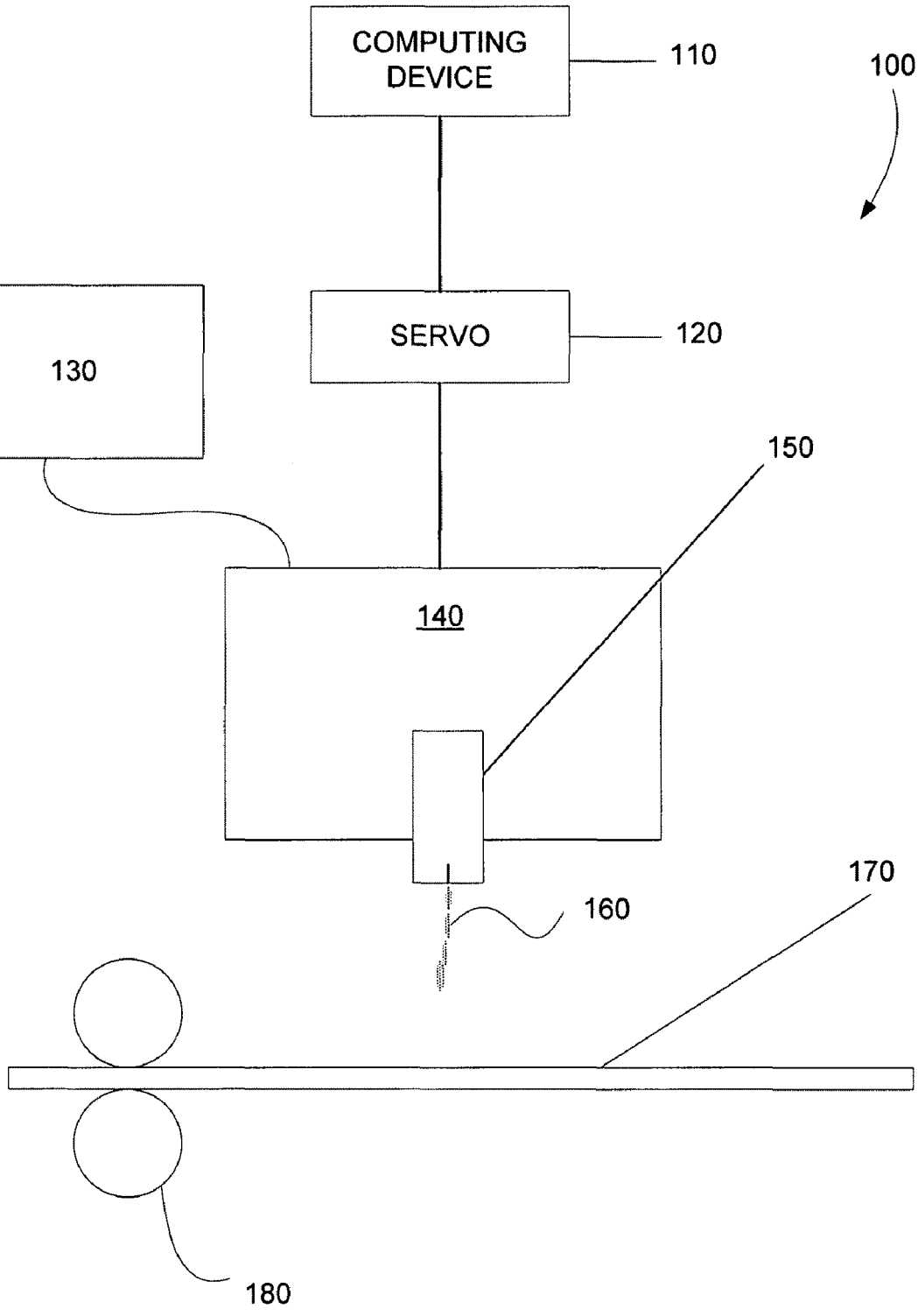
FIG. 1 is a simple block diagram illustrating an inkjet material dispensing system, according to one exemplary embodiment.

The present specification discloses an exemplary ink recording material having high gloss and curl control without a special back coat formulation. According to one exemplary embodiment disclosed herein, the ink recording material includes a layer of a fumed silica formulation including between approximately 5 and 30% alumina. Further details of the present ink recording material will be provided below.

Before particular embodiments of the present system and method are disclosed and described, it is to be understood that the present system and method are not limited to the particular process and materials disclosed herein as such may vary to some degree. It is also to be understood that the terminology used herein is used for the purpose of describing particular embodiments only and is not intended to be limiting, as the scope of the present system and method will be defined only by the appended claims and equivalents thereof.

As used in the present specification and in the appended claims, the term "ink" is defined to include liquid compositions that can include colorants, such as pigments and/or dyes, as well as liquid vehicles configured to carry the colorants to a substrate. Liquid vehicles are well known in the art, and a wide variety of liquid vehicle components may be used in accordance with embodiments of the present exemplary system and method. Such liquid vehicles may include a mixture of a variety of different agents, including without limitation, surfactants, co-solvents, buffers, biocides, viscosity modifiers, sequestering agents, stabilizing agents, and water. Though not liquid per se, the liquid vehicle can also carry other solids, such as polymers, UV curable materials, plasticizers, salts, etc.

Concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a weight range of approximately 1 wt % to about 20 wt % should be interpreted to include not only the explicitly recited concentration limits of 1 wt % to about 20 wt %, but also to include individual concentrations such as 2 wt %, 3 wt %, 4 wt %, and sub-ranges such as 5 wt % to 15 wt %, 10 wt % to 20 wt %, etc.

As used in the present specification and the appended claims, the term "high surface area fumed silica" is meant to be understood as including any fumed silica particles having a surface area greater than approximately 120 $m^2$ per gram.

Additionally, as used herein, the term "high molecular weight polyvinyl alcohol binder" or "high molecular weight PVA binder" shall be interpreted as including any polyvinyl alcohol based binder having a molar mass of 150,000 grams per mol or more. According to one exemplary embodiment, high molecular weight polyvinyl alcohol binders shall be interpreted as including, but not being limited to, Poval 235 and Poval 245, manufactured by Kuraray America, Inc.

Further, as used herein, the term "curling" shall be understood to refer to any distortion of a sheet of paper or other inkjet recording medium due to differences in coating from one side to another or due to absorption of moisture.

In the following description, for purposes of explanation, numerous specific details are set forth in order to provide a thorough understanding of the present system and method for producing an exemplary ink recording material having improved curl response without a special back coat formulation. It will be apparent, however, to one skilled in the art, that the present method may be practiced without these specific details. Reference in the specification to "one embodiment" or "an embodiment" means that a particular feature, structure, or characteristic described in connection with the embodiment is included in at least one embodiment. The appearance of the phrase "in one embodiment" in various places in the specification are not necessarily all referring to the same embodiment.

Exemplary Structure

FIG. 1 illustrates an exemplary system (100) that may be used to apply an inkjet ink (160) to an ink receiving structure (170), according to one exemplary embodiment. As shown in FIG. 1, the present system includes a computing device (110) controllably coupled through a servo mechanism (120) to a moveable carriage (140) having an inkjet dispenser (150) disposed thereon. A material reservoir (130) is coupled to the moveable carriage (140), and consequently to the inkjet print head (150). A number of rollers (180) are located adjacent to the inkjet dispenser (150) configured to selectively position an ink receiving structure (170). The above-mentioned components of the present exemplary system (100) will now be described in further detail below.

The computing device (110) that is controllably coupled to the servo mechanism (120), as shown in FIG. 1, controls the selective deposition of an inkjet ink (160) on an ink receiving structure (170). A representation of a desired image or text may be formed using a program hosted by the computing device (110). That representation may then be converted into servo instructions that are then housed in a processor readable medium (not shown). When accessed by the computing device (110), the instructions housed in the processor readable medium may be used to control the servo mechanisms (120) as well as the movable carriage (140) and inkjet dispenser (150). The computing device (110) illustrated in FIG. 1 may be, but is in no way limited to, a workstation, a personal computer, a laptop, a digital camera, a personal digital assistant (PDA), or any other processor containing device.

The moveable carriage (140) of the present printing system (100) illustrated in FIG. 1 is a moveable material dispenser that may include any number of inkjet material dispensers (150) configured to dispense the inkjet ink (160). The moveable carriage (140) may be controlled by a computing device (110) and may be controllably moved by, for example, a shaft system, a belt system, a chain system, etc. making up the servo mechanism (120). As the moveable carriage (140) operates, the computing device (110) may inform a user of operating conditions as well as provide the user with a user interface.

As an image or text is printed on the ink receiving structure (170), the computing device (110) may controllably position the moveable carriage (140) and direct one or more of the inkjet dispensers (150) to selectively dispense an inkjet ink at predetermined locations on the ink receiving structure (170) as digitally addressed drops, thereby forming the desired image or text. The inkjet material dispensers (150) used by the present printing system (100) may be any type of inkjet dispenser configured to perform the present method including, but in no way limited to, thermally actuated inkjet dispensers, mechanically actuated inkjet dispensers, electrostatically actuated inkjet dispensers, magnetically actuated dispensers, piezoelectrically actuated dispensers, continuous inkjet dispensers, etc. Additionally, the present ink receiving structure (170) may receive inks from non-inkjet sources such as, but in no way limited to, screen printing, stamping, pressing, gravure printing, and the like.

The material reservoir (130) that is fluidly coupled to the inkjet material dispenser (150) houses and supplies an inkjet ink (160) to the inkjet material dispenser. The material reservoir may be any container configured to hermetically seal the inkjet ink (160) prior to printing.

FIG. 1 also illustrates the components of the present system that facilitate reception of the pigment and/or dye-based inkjet ink (160) onto the ink receiving structure (170). As shown in FIG. 1, a number of positioning rollers (180) may transport and/or positionally secure an ink receiving structure (170) during a printing operation. Alternatively, any number of belts, rollers, substrates, or other transport devices may be used to transport and/or positionally secure the ink receiving structure (170) during a printing operation, as is well known in the art.

The present system and methods provide an ink receiving structure (170) with improved curl response without a special back coat formulation, the composition of which will now be described in detail below.

Exemplary Composition

Figure 2:
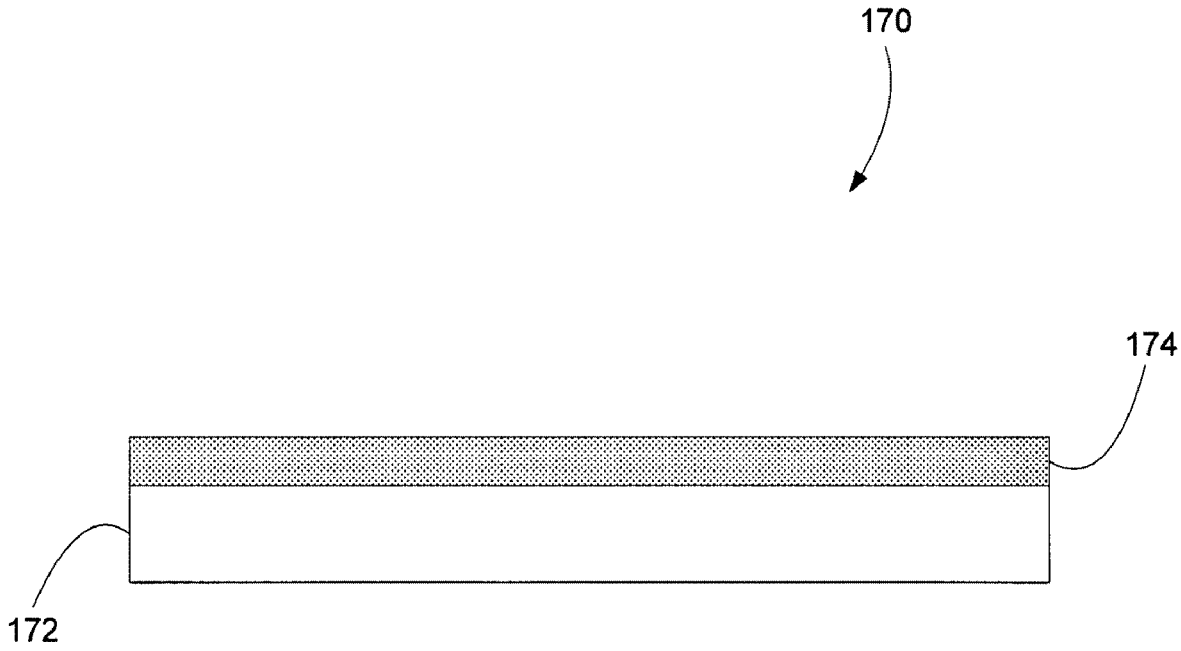
FIG. 2 is a side cross-sectional view illustrating the layers of an inkjet recording substrate, according to one exemplary embodiment.

One exemplary composition of the present exemplary ink receiving structure (170) configured to receive an inkjet ink (160) is illustrated in FIG. 2. As shown in FIG. 2, the present exemplary ink receiving structure (170) includes a base layer (172), and a layer of a high surface area fumed silica formulation including between approximately 5 and 30% alumina (174) formed thereon. As a result of the present formulation, the disclosed ink receiving structure (170) improves curl response without the inclusion of a special back coat formulation, as is often included in ink receiving structures. The individual components of the present ink receiving structure (170) will be described in further detail below.

Base Layer

According to one exemplary embodiment, the present exemplary ink receiving structure (170) is formed on a resin coated base layer (172) or support. According to this exemplary embodiment, any number of the usual resin coated base supports used in the manufacture of transparent or opaque photographic material may also be employed in the practice of the present system and method. While any number of resin coated base layers may be used according to the present exemplary system and method, the present exemplary ink receiving structure (170) will be described herein as having a resin coated base layer (172) comprised of a standard polyethylene extruded base. Alternatively, any number of resin coated supports may be used including, but in no way limited to, clear films, such a cellulose esters, including cellulose triacetate, cellulose acetate, cellulose propionate, or cellulose acetate butyrate, polyesters, including poly(ethylene terephthalate), polyimides, polycarbonates, polyamides, polyolefins, poly(vinyl acetals), polyethers, polyvinyl chloride, and polysulfonamides. Polyester film supports, and especially poly(ethylene terephthalate), such as manufactured by du Pont de Nemours under the trade designation of MELINEX, may be selected because of their excellent dimensional stability characteristics. Further, opaque photographic materials may be used as the resin coated base layer (172) including, but in no way limited to, baryta paper, polyethylene-coated papers, and voided polyester.

Non-photographic materials, such as transparent films for overhead projectors, may also be used for the support material. Examples of such transparent films include, but are not limited to, polyesters, diacetates, triacetates, polystyrenes, polyethylenes, polycarbonates, polymethacrylates, cellophane, celluloid, polyvinyl chlorides, polyvinylidene chlorides, polysulfones, and polyimides.

While the present exemplary ink receiving structure (170) is described within the context of utilizing a resin coated base layer (172), any number of alternative support materials may be used as a base layer by the present exemplary system and method. Alternative support materials that may be incorporated by the present system and method to serve as the resin coated base layer (172) include plain paper of various different types, including, but in no way limited to, plain papers, pigmented papers, and cast-coated papers, as well as metal foils, such as foils made from alumina.

Fumed Silica/Alumina Blend

As illustrated in FIG. 2, the base layer (172) is coated on at least one surface with a high surface area fumed silica formulation including between approximately 5 and 30% alumina (174). According to one exemplary embodiment, the alumina includes a boehmite hydrated alumina having a high porosity. The dry coatweight of the layer of high surface area fumed silica dispersion including between approximately 5 and 30% alumina (174) is about 10 to 55 GSM but preferably from 15 to 40 GSM. According to one exemplary embodiment, the layer of high surface area fumed silica including between approximately 5 and 30% alumina (174) includes a high surface area fumed silica dispersion having fumed silica, alumina particles, a binder, and any number of cross-linkers, surfactants, dispersants, rheology modifiers, mordents, salts, and/or plasticisers. The resulting formulation provides controllable gloss levels and fade performance while reducing curl levels without the inclusion of a special back coat formulation. Further details of the individual components of the high surface area fumed silica formulation including between approximately 5 and 30% alumina (174) will be provided below.

As mentioned, the high surface area fumed silica formulation including between approximately 5 and 30% alumina (174) includes a fumed silica dispersion. According to one exemplary embodiment, the fumed silica of the fumed silica dispersion can have a surface area of between approximately 125 and 275 $m^2/g$. According to this exemplary embodiment, the fumed silica can be selected from the following group of commercially available fumed silica from Cabot: Cab-O-Sil LM-150, Cab-O-Sil M-5, Cab-O-Sil MS-55, Cab-O-Sil MS-75D, Cab-O-Sil H-5, Cab-O-Sil HS-5, Cab-O-Sil EH-5. The fumed silica can also be selected from fumed silica manufactured by Orisil, Degussa, Prodexim, Chalco or any other fumed silica manufacturer.

According to one exemplary embodiment, the fumed silica used in the silica dispersion may be treated with aluminum chlorohydrate (ACH) or silane coupling agents containing amino functional groups, or a combination of both. According to this exemplary embodiment, the fumed silica may be present in aggregates. Specifically, according to one exemplary embodiment, the aggregate size of the fumed silica is between approximately 50 to 300 nm in size. More specifically, the fumed silica is preferred between approximately 100 to 250 nm in size. The Brunauer-Emmett-Teller (BET) surface area of the fumed silica is between approximately 100 to 400 square meters per gram. More specifically, the fumed silica is can have a BET surface area of 150 to 300 square meters per gram. Accordingly, the zeta potential, or the electrokinetic measurement used to control the stability of a colloid, of the organic treated silica at a pH of 3.5 is at least 20 mV.

As mentioned above, the layer of fumed silica or alumina can be treated with silane coupling agents containing functional groups, ACH, or combinations thereof. According to one exemplary embodiment, the silane coupling agents contain functional groups such as primary amine, secondary amine, tertiary amine, quaternary amine, etc. According to this exemplary embodiment, the silane coupling agent with the amine functional group is used to convert the anionic silica to a cationic silica that is configured to fix an anionic dye that is dispensed thereon.

In addition to the fumed silica, the present exemplary fumed silica formulation includes between approximately 5 and 30% alumina particles. According to one exemplary embodiment, the alumina particles include either boehmite or fumed alumina with surface areas ranging between approximately 80 and 250 $m^2/g$, with a preferred surface area of 150-200 $m^2/g$. According to one exemplary embodiment, the boehmite particles are rare earth-modified boehmite, containing from about 0.04 to 4.2 mole percent of at least one rare earth metal having an atomic number from 57 to 71 of the Periodic Table of Elements. According to this exemplary embodiment, the rare earth elements are selected from the group consisting of lanthanum, ytterbium, cerium, neodymium, praseodymium, and mixtures thereof. The presence of the rare earth changes the pseudo-boehmite structure to the boehmite structure. The presence of the rare earth element provides superior light fastness, compared with an alumina not including the rare earth element. The preparation of the pseudo-boehmite layer modified with rare earths is more fully described in U.S. Pat. No. 6,156,419, the contents of which are incorporated herein by reference.

According to one exemplary embodiment, the use of the alumina particles provides higher gloss than traditional fumed silica due to the overall particle size of the alumina particles. The dispersed particle size is, according to one exemplary embodiment, between 120-200 nm with a preferred particle size of 150-180 nm. A non limiting example of a boehmite alumina that can be used is HP14, manufactured by Sasol. Specifically, according to one exemplary embodiment, the gloss of the resulting layer is a function of overall particle size. The alumina of the present exemplary system and method is typically a platelet or block structure, allowing alignment of the particles. According to one exemplary embodiment, the high surface area boehmite or fumed alumina have a crystalline structure and particle size that allows alignment, resulting in a higher glossed surface area.

The high surface area fumed silica formulation including between approximately 5 and 30% alumina (174) also includes a binder. According to one exemplary embodiment, the present exemplary fumed silica formulation including between approximately 5 and 30% alumina includes a polyvinyl alcohol (PVA) binder. According to one exemplary embodiment, any number of high molecular weight PVA binders may be used in connection with the high surface area fumed alumina including, but in no way limited to, Poval 235 and Poval 245, commercially available from Kuraray, Inc. Other medium to high molecular weight polyvinyl alcohol binders from Kuraray such as Mowiol 40-88 can be chosen or the comparable Celvol polyvinyl alcohol made by Celanese.

Particularly, according to one exemplary embodiment, the PVA binder may be a partially hydrolyzed PVA hydrolyzed at between approximately 82 to 98%. Further, according to one exemplary embodiment, the PVA binder is crosslinked to provide waterfastness to the resulting ink receiving layer. While any ratio of binder to silica may be used, according to one exemplary embodiment, the formulation may have between approximately 5 and 25% binder.

In addition to the above-mentioned components, the fumed silica/alumina formulation (174) may also contain any number of crosslinkers, surfactants, dispersants, rheology modifiers, mordents, salts, plasticizers, and other additives that are well known in the art.

During application, the fumed silica dispersion including between approximately 5 and 30% alumina (174) can be coated onto the base layer (172) by any number of material dispensing machines and/or methods including, but in no way limited to, a slot coater, a curtain coater, a cascade coater, a blade coater, a rod coater, a gravure coater, a Meier rod coater, a wired coater, and the like. Further details of the method of formation of the present exemplary fumed silica dispersion including between approximately 5 and 30% alumina layer (174) will be provided below with reference to FIG. 3.

Exemplary Formation

Figure 3A:
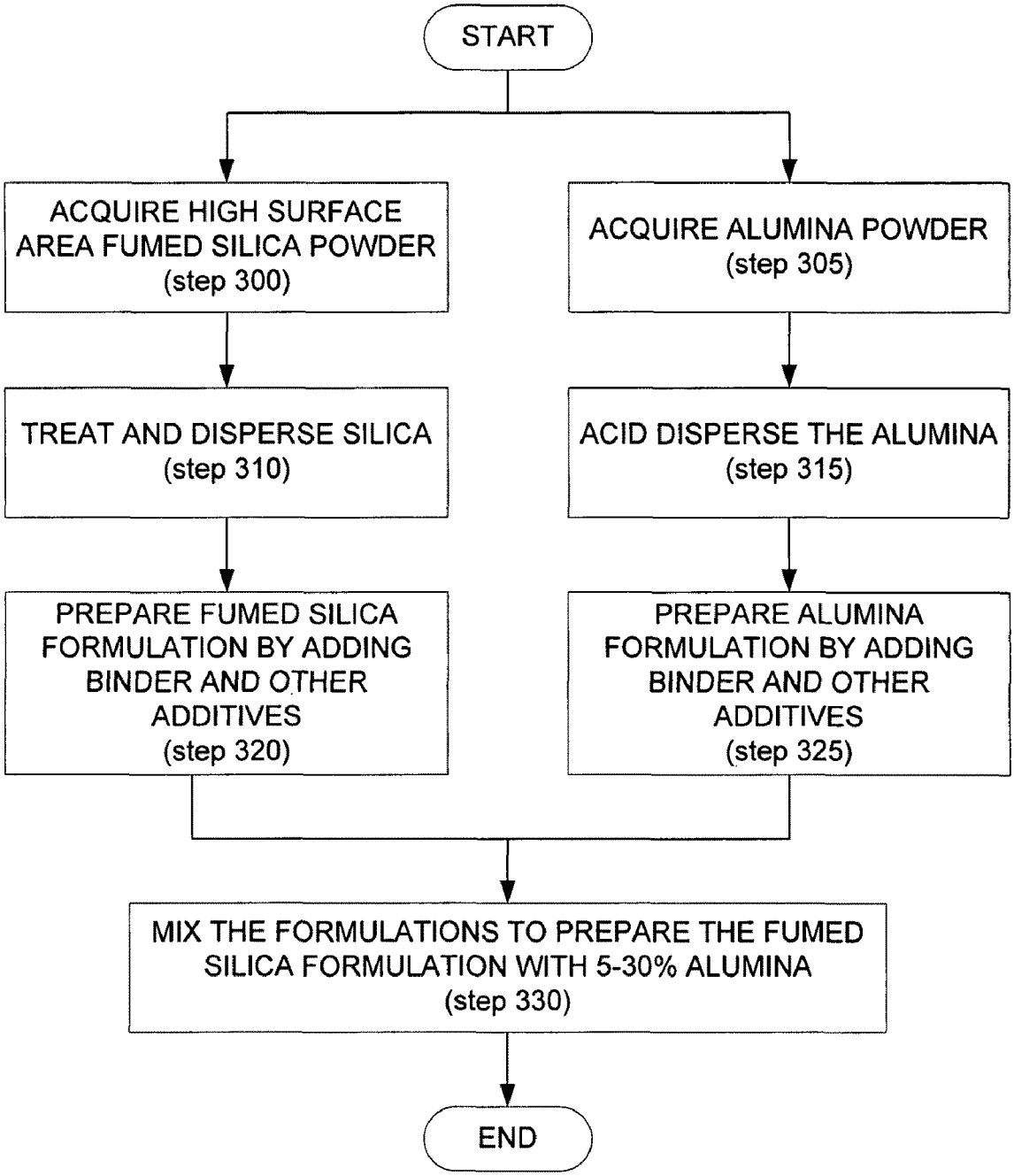
FIGS. 3A and 3B are flow charts illustrating various methods for forming an inkjet recording coating, according to a number of exemplary embodiments.
Figure 3B:
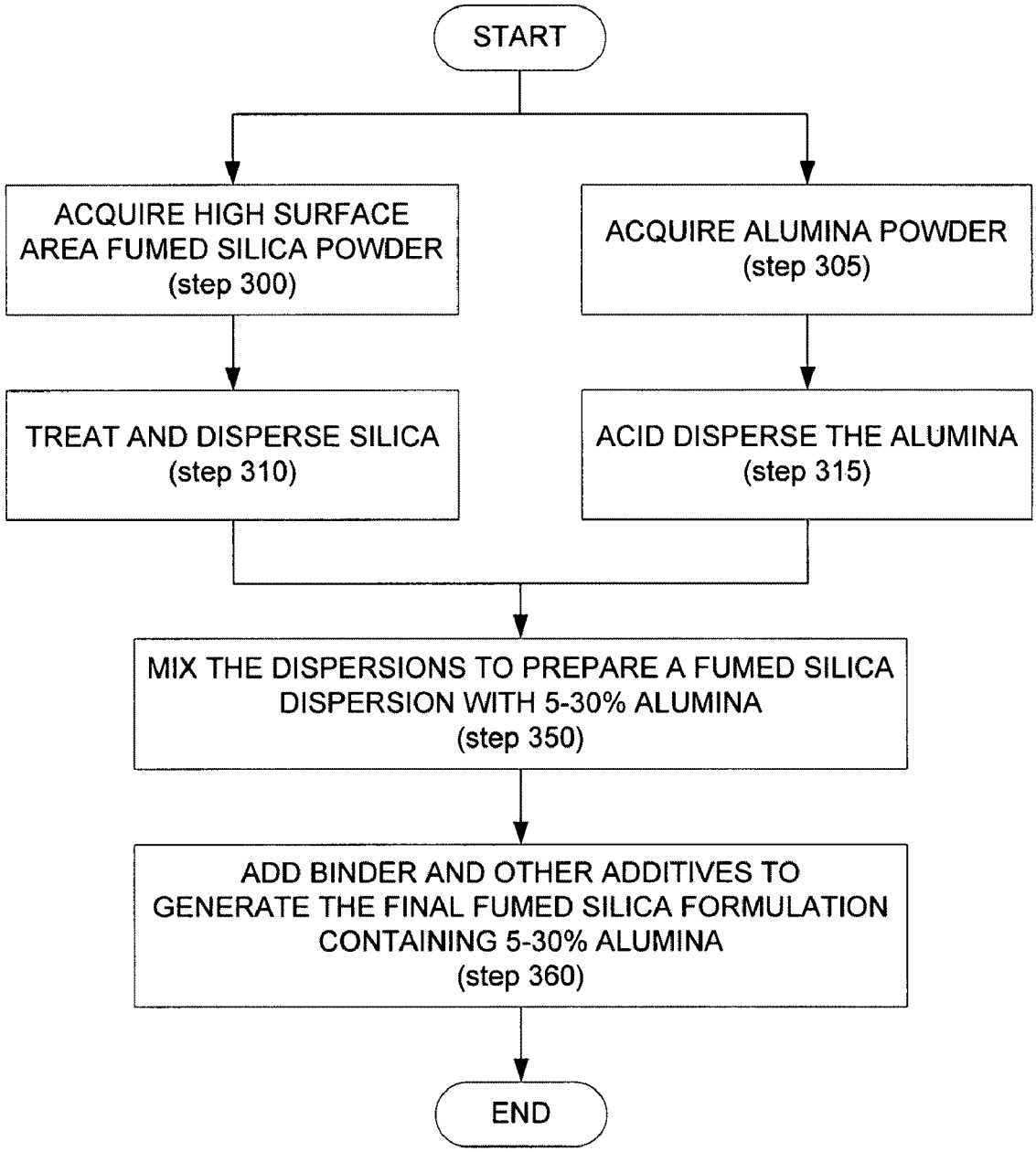

FIGS. 3A and 3B illustrate exemplary methods for forming the present exemplary fumed silica dispersion including between approximately 5 and 30% alumina layer (174) on a base layer (172), according to one exemplary embodiment. As illustrated in FIG. 3, the present exemplary formation methods begins by first acquiring a fumed silica powder (step 300). Additionally, a desired alumina powder is acquired (step 305).

Once the fumed silica and alumina powders are acquired, dispersions are prepared. According to one exemplary embodiment, fumed silica is treated and dispersed (step 310) and the alumina is acid dispersed (step 315) separately. Specifically, according to one exemplary embodiment, boehmite or other alumina are acid dispersible (step 315). According to one exemplary embodiment, in between 15 and 35 percent alumina is placed in de-ionized water. An acid is then added to the solution to disperse the boehmite or other alumina to get a pH of between approximately 2.5 and 4.5, preferably between 3.5 and 4.0. Once the dispersion has stabilized, a formulation with additional additives as mentioned above may be prepared (step 325).

Generation of the silica component may include treating the silica with ACH and an amino-silane coupling agent, producing a desired zeta potential, and generating the desired dispersion (step 310). Specifically, according to one exemplary embodiment, a dual treatment process may be performed wherein the silica component is treated with both ACH and the amino-silane coupling agent. Alternatively, the silica may be treated with only the ACH or only the amino-silane coupling agent may be separately prepared and then mixed to form the desired coating. The silica may be treated during or after the dispersion process. The dispersion process for fumed silica is well known in the art and can be performed by using any number of dispersing equipment including, but not limited to equipment made by Kady or Ystral. Once the dispersion of treated fumed silica is made, binder may then be added at the ratios mentioned above to form a formulation (step 320). According to one exemplary embodiment, high molecular weight binder such s Poval 235 or Poval 245, or any lower molecular weight binder may be used.

Once both formulations are generated, they may be combined to form the final formulation (step 330). As mentioned previously, the fumed silica dispersion and the alumina dispersion may be combined to form a fumed silica formulation containing between approximately 5 and 30% alumina. While the mixture has been described herein as a combination of two separately formed formulations, the desired final formulation may be generated as a single formulation from the respective silica and alumina dispersions, according to one exemplary embodiment illustrated in FIG. 3B. As shown, the dispersions may be combined to form a fumed silica dispersion with 5-30% alumina (step 350), followed by the addition of binder and other additives to generate the final fumed silica formulation (step 360).

With the fumed silica and alumina mixture prepared, it may then be applied to a desired base. According to one exemplary embodiment, the fumed silica and alumina mixture may be applied to a desired resin coated base layer or paper base using any number of known coating techniques including, but in no way limited to, a slot coater, a curtain coater, a cascade coater, a blade coater, a rod coater, a gravure coater, a Meier rod coater, a wired coater, and the like. Further details and examples of the present exemplary fumed silica and alumina mixture, as well as its performance compared to traditional silica coatings will be provided below.

Example

According to a first exemplary embodiment, 5 paper base mediums and 5 photobase mediums were coated with fumed silica dispersions having varying quantities of alumina particles, as illustrated in Table 1 below.

TABLE 1

| Sheet | Silica content | Alumina content | % Si |
|---|---|---|---|
| 1 | 0 | 100 | 0% |
| 2 | 50 | 100 | 33% |
| 3 | 100 | 100 | 50% |
| 4 | 100 | 50 | 67% |
| 5 | 100 | 0 | 100% |

As illustrated in Table 1, the exemplary test mediums had percentages of fumed silica content ranging from 0% up to 100%, with the balance being alumina particles, as described previously. Once the exemplary test mediums were manufactured, the exemplary mediums were placed in varying environmental conditions. Particularly, portions of each of the five samples were placed in environments of 23° C./50% humidity, 15° C./20% humidity, and 30° C./80% humidity and allowed to equilibrate for at least 4 hours. After both 4 and 24 hours of equilibration, an eight point curl measurement battery was performed on each sample. In an eight point curl measurement, the deviation that the paper curls away from a plane is measured in mm at each corner and each axis. The results of the eight point curl measurement batteries were recorded and the results are illustrated in FIGS. 4-7.

Figure 4:
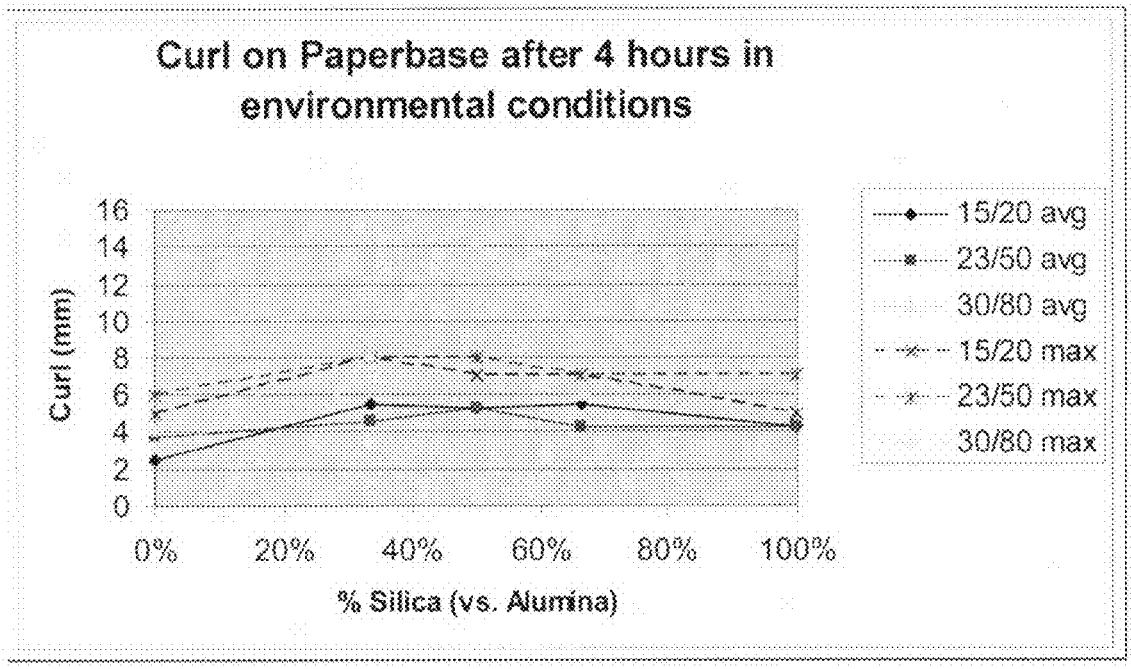
FIG. 4 is a chart illustrating the results of an eight point curl test on various paper based media after four hours of exposure to controlled environments, according to one exemplary embodiment.
Figure 5:
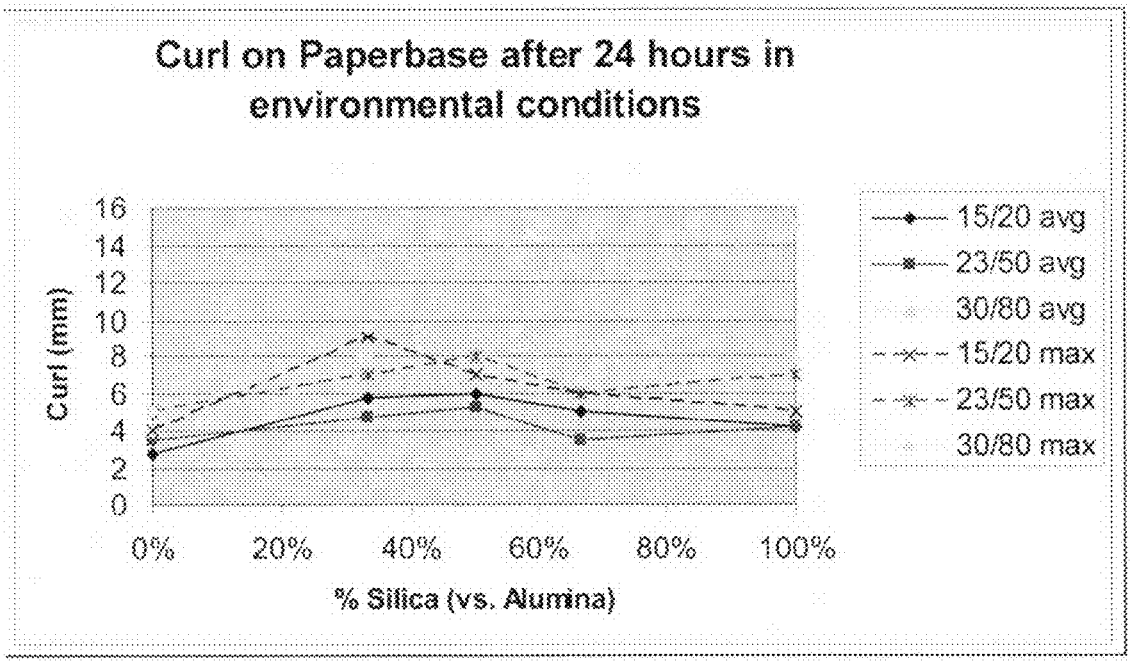
FIG. 5 is a chart illustrating the results of an eight point curl test on various paper based media after 24 hours of exposure to controlled environments, according to one exemplary embodiment.

As illustrated in FIGS. 4 and 5, the paper based substrates coated with approximately 75% fumed silica exhibited reduced curl when compared to the corresponding samples coated with either 50% or 100% fumed silica, under identical environmental conditions.

Figure 6:
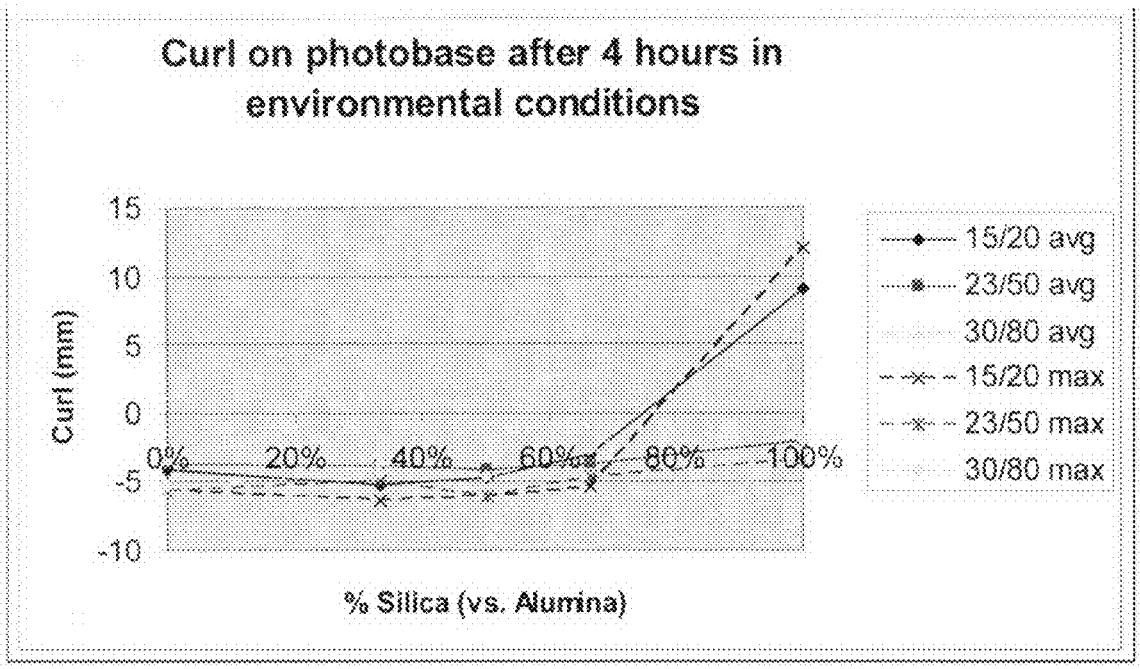
FIG. 6 is a chart illustrating the results of an eight point curl test on various photo based media after four hours of exposure to controlled environments, according to one exemplary embodiment.
Figure 7:
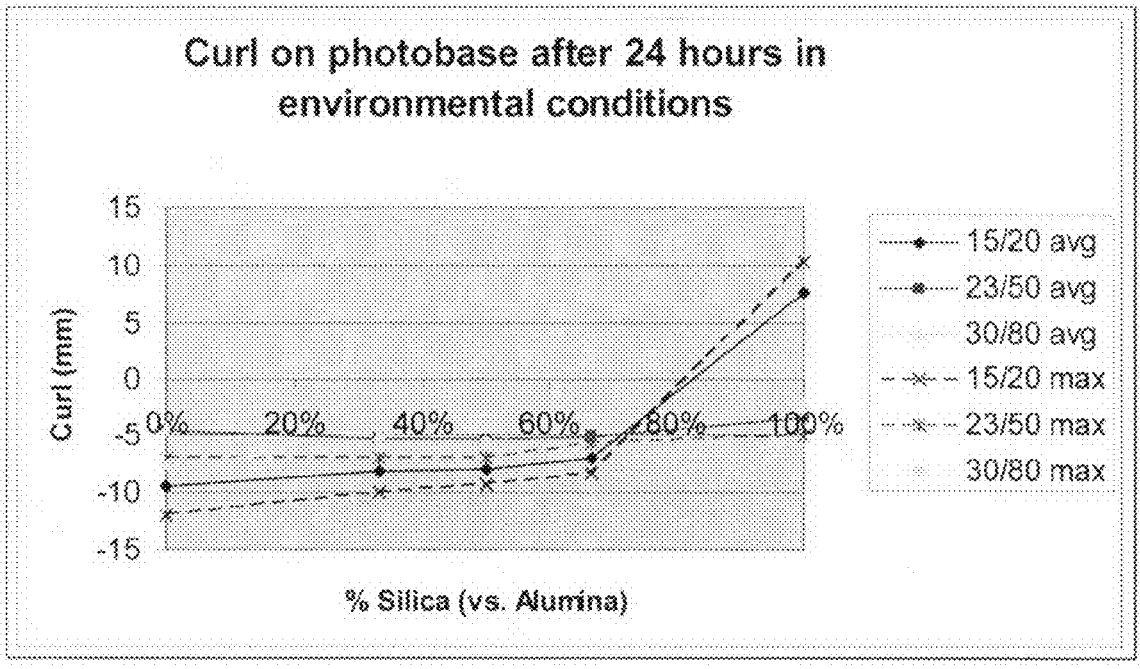
FIG. 7 is a chart illustrating the results of an eight point curl test on various photo based media after 24 hours of exposure to controlled environments, according to one exemplary embodiment.

Similarly, as illustrated in FIGS. 6-7, the photo based substrates comprising 100% fumed silica exhibit relatively large amounts of curl when compared to the samples coated with approximately 75% fumed silica. According to test results, the inclusion of between approximately 5-30% alumina in a fumed silica/alumina dispersion reduces curl over pure fumed silica by more than 5 mm at 20% humidity.

Additionally, the light fade performance and gloss levels of the above-mentioned coatings were tested. The results of the testing are illustrated in Table 2 below.

TABLE 2

| Lightfade | | | | | |
|---|---|---|---|---|---|
| Sample ID | 0% Si | 33% Si | 50% Si | 66% Si | 100% Si |
| Years to Failure | 66.6 | 61.6 | 49.0 | 44.4 | 34.0 |

As illustrated in Table 2, the light fade performance of a print on the samples with approximately 75% fumed silica was enhanced when compared to samples having 100% fumed silica. Additionally, the presence of small particle size alumina can enhance the gloss of the coating. 20° gloss could be increased up to 2-3% and 60° gloss could be increased up to 4% at 33% alumina level. The gloss enhancement is more significant at higher ratios of alumina.

In conclusion, the above-mentioned examples illustrate a reduction in curl for ink receiving media coated with a fumed silica/alumina formulation having between approximately 5-30% alumina. More specifically, the exemplary ink recording material incorporating a layer of fumed silica in combination with between approximately 5% and 30% alumina particles exhibited reduced curl while providing an enhanced gloss when compared to a pure silica dispersion ink receiving substrate.

The preceding description has been presented only to illustrate and describe exemplary embodiments of the present system and method. It is not intended to be exhaustive or to limit the system and method to any precise form disclosed. Many modifications and variations are possible in light of the above teaching. It is intended that the scope of the system and method be defined by the following claims.

What is claimed is:

1. An ink receiving structure comprising:

a base substrate; and a single ink receptive coating formed on said base substrate;

wherein said ink receptive coating includes a binder and a fumed silica and alumina dispersion; wherein said fumed silica and alumina dispersion includes between 15 and 25% alumina particles and 70-95% fumed silica;

wherein said ink receiving structure does not include a back coat and exhibits less than 5 mm of curl at 20% humidity.

2. The ink receiving structure of claim 1, wherein said fumed silica and alumina dispersion comprises fumed silica particles with a surface area between 125 and 275 $m^2/g$.

3. The ink receiving structure of claim 1, wherein said fumed silica and alumina dispersion comprises a porous boehmite hydrated alumina.

4. The ink receiving structure of claim 2, wherein said fumed silica is cationic and has a zeta potential greater than 20 mV.

5. The ink receiving structure of claim 2, wherein said fumed silica is treated with one of an aluminum chlorohydrate (ACH) or a silane coupling agents containing amino functional groups or both.

6. The ink receiving structure of claim 1, wherein said alumina particles comprise boehmite or fumed alumina particles.

7. The ink receiving structure of claim 6, wherein said alumina particles have a surface area between 80 and 250 $m^2/g$.

8. The ink receiving structure of claim 1, wherein said binder comprises polyvinyl alcohol (PVA) binder.

9. The ink receiving structure of claim 1, wherein said base substrate comprises a polyethylene extruded base.

10. The ink receiving structure of claim 1, wherein a dry coatweight of said ink receptive coating comprises between approximately 15 to 40 GSM.

11. The ink receiving structure of claim 1, wherein said fumed silica and alumina dispersion includes between 15 and 25% alumina particles.

12. An ink receiving structure comprising:

a polyethylene extruded base; and a single layer ink receptive coating formed on a first surface of said polyethylene extruded base, said ink receptive coating comprising:

cationic fumed silica particles with a surface area between 125 and 275 $m^2/g$ with a zeta potential greater than 20 mV, said fumed silica particles being dual treated with aluminum chlorohydrate (ACH) and silane coupling agents containing amino functional groups;

porous boehmite hydrated alumina having a surface area between 80 and 250 $m^2/g$, said alumina comprising 0.04 to 4.2 mole percent of at least one rare earth metal, said ink receptive coating 15 and 25% alumina particles; and 82-98% partially hydrolyzed PVA binder, said ink receptive coating comprising between 5 to 25% of said binder;

wherein a dry coatweight of said ink receptive coating comprises between approximately 15 to 40 GSM;

wherein said ink receiving structure does not have a back coat on a surface opposite said first surface and generates curl levels half that of a base substrate coated with 100% fumed silica particles.

13. An ink receiving structure comprising:

a base substrate; and a single ink receptive coating formed on a first side of said base substrate;

wherein said ink receptive coating includes an 82-98% partially hydrolyzed PVA binder and a fumed silica and alumina dispersion; wherein said fumed silica and alumina dispersion includes between 5 and 30% alumina particles and between 70 and 95% fumed silica particles; and wherein said ink receiving structure does not have a back coat on a second side of said base substrate and generates curl levels half that of a base substrate containing 100% fumed silica particles.

14. The ink receiving structure of claim 13, wherein said fumed silica dispersion comprises fumed silica particles with a surface area between 125 and 275 $m^2/g$.

15. The ink receiving structure of claim 14, wherein said fumed silica is cationic and has a zeta potential greater than 20 mV.

16. The ink receiving structure of claim 14, wherein said fumed silica is treated with one of an aluminum chlorohydrate (ACH) or a silane coupling agents containing amino functional groups or both.

17. The ink receiving structure of claim 13, wherein said alumina particles contain boehmite or fumed alumina particles.

18. The ink receiving structure of claim 17, wherein said alumina particles have a surface area between 80 and 250 $m^2/g$.

* * * * *